US008863658B2

(12) United States Patent
Morlock et al.

(10) Patent No.: US 8,863,658 B2
(45) Date of Patent: Oct. 21, 2014

(54) PAD PRINTING MACHINE

(75) Inventors: Claus Morlock, Baiersbronn (DE); Wilfried Beron, Stuttgart (DE)

(73) Assignee: ITW Morlock GmbH, Dornstetten (DE)

( * ) Notice: Subject to any disclaimer, the term of this patent is extended or adjusted under 35 U.S.C. 154(b) by 1158 days.

(21) Appl. No.: 12/529,256

(22) PCT Filed: Mar. 27, 2008

(86) PCT No.: PCT/IB2008/000730

§ 371 (c)(1),
(2), (4) Date: Aug. 31, 2009

(87) PCT Pub. No.: WO2008/129375

PCT Pub. Date: Oct. 30, 2008

(65) Prior Publication Data

US 2010/0031836 A1 Feb. 11, 2010

(30) Foreign Application Priority Data

Apr. 21, 2007 (DE) ..... 10 2007 018 965

(51) Int. Cl.

| | |
|---|---|
| ***B41F 17/00*** | (2006.01) |
| ***B41F 17/02*** | (2006.01) |
| ***B41F 9/10*** | (2006.01) |
| ***B41F 33/00*** | (2006.01) |

(52) U.S. Cl.

CPC ..... *B41F 17/001* (2013.01); *B41F 33/0018* (2013.01)

USPC ..... 101/41; 101/163

(58) Field of Classification Search

USPC ..... 101/41, 163, 170, 333, 474, 492
IPC ..... B41F 17/00,17/02
See application file for complete search history.

(56) References Cited

U.S. PATENT DOCUMENTS

| | | | | |
|---|---|---|---|---|
| 5,136,948 | A * | 8/1992 | Fujino et al. | 101/486 |
| 5,392,706 | A | 2/1995 | Drew, II et al. | |
| 6,748,860 | B2 * | 6/2004 | Loffler et al. | 101/365 |
| 6,983,688 | B1 * | 1/2006 | Papa et al. | 101/41 |
| 7,474,983 | B2 * | 1/2009 | Mazalek et al. | 702/150 |
| 7,659,880 | B2 * | 2/2010 | Miyazawa | 345/102 |
| 2003/0183098 | A1 * | 10/2003 | Vogt et al. | 101/35 |
| 2004/0094050 | A1 * | 5/2004 | Ackley et al. | 101/44 |
| 2006/0102022 | A1 * | 5/2006 | Wessells | 101/38.1 |

FOREIGN PATENT DOCUMENTS

| | | | | |
|---|---|---|---|---|
| DE | 4239052 | * | 6/1994 | B41F 33/06 |
| EP | 0581096 | A2 | 2/1994 | |

OTHER PUBLICATIONS

ISR for PCT/IB2008/000730 dated Aug. 8, 2008.

* cited by examiner

*Primary Examiner* — Leslie J Evanisko
*Assistant Examiner* — Marissa Ferguson Samreth
(74) *Attorney, Agent, or Firm* — Lowe Hauptman & Ham LLP

(57) ABSTRACT

A pad printing machine comprising a work board. The work board is situated in front of the pad printing machine and fitted with an optical display displaying given operational states of the pad printing machine to an operator.

10 Claims, 4 Drawing Sheets

PAD PRINTING MACHINE

RELATED APPLICATIONS

The present application is based on International Application Number PCT/IB2008/000730 filed Mar. 27, 2008, and claims priority from German Application Number 10 2007 018 965.8, filed Apr. 21, 2007, the disclosures of which are hereby incorporated by reference herein in their entirety.

The present invention relates to a pad printing machine fitted with a work board and defined in the preamble of claim 1.

Pad printing machines are known for instance from WO2004/113075 A1 and EP 1 053 882 B1.

Pad printing machines may be designed to be manually fed, the workpieces to be printed being manually inserted into, and removed from, the printing machine.

Moreover the pad printing machines may be automated, the workpieces to be printed being fed to and removed from them in automated manner. Frequently enough, particular workpieces must be removed manually from such automated machines during operation, or be reinserted manually, for instance for quality control.

Again tools and printing accessories such as printing blocks/plates, pads and ink cups sometimes must be checked or exchanged.

The objective of the present invention is to make easier manual work for a pad printing machine operator.

This problem is solved by the features of claim 1 of the present invention.

Further features of this invention are defined in the dependent claims.

The present invention is elucidated below and in relation to the appended drawings by means of preferred embodiment modes disclosing further features.

Figure 1:
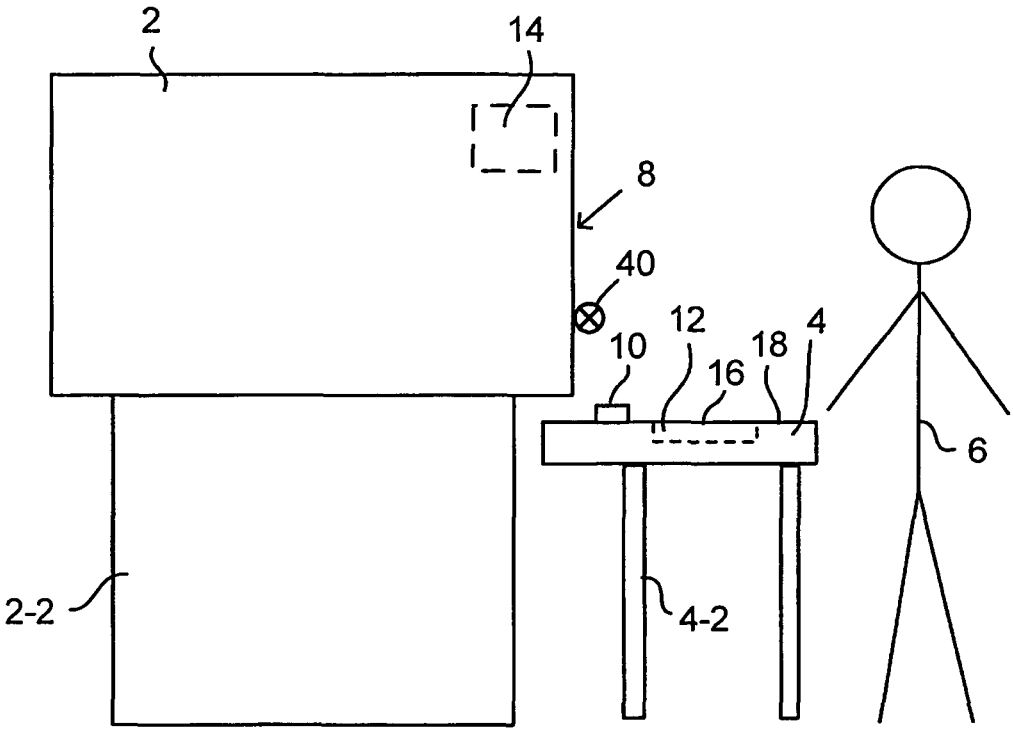
Figure 2:
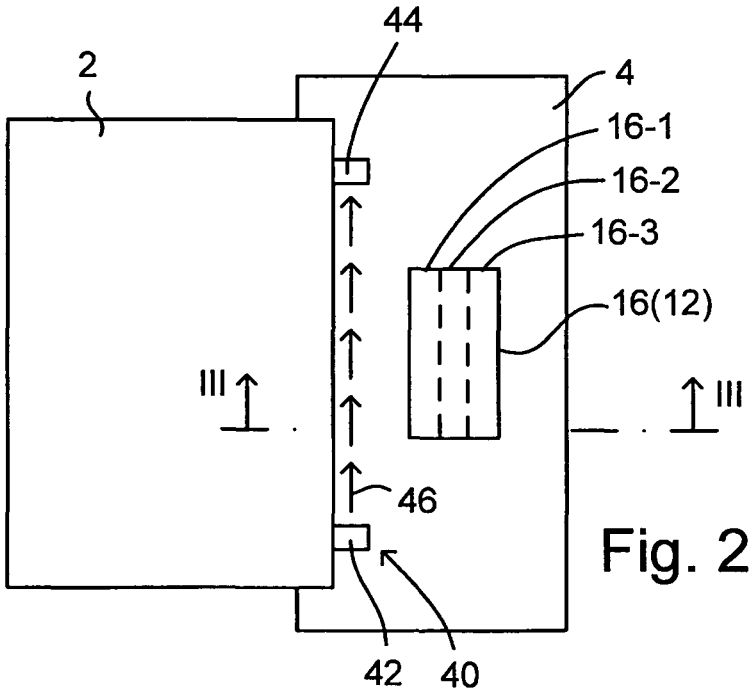
Figure 3:
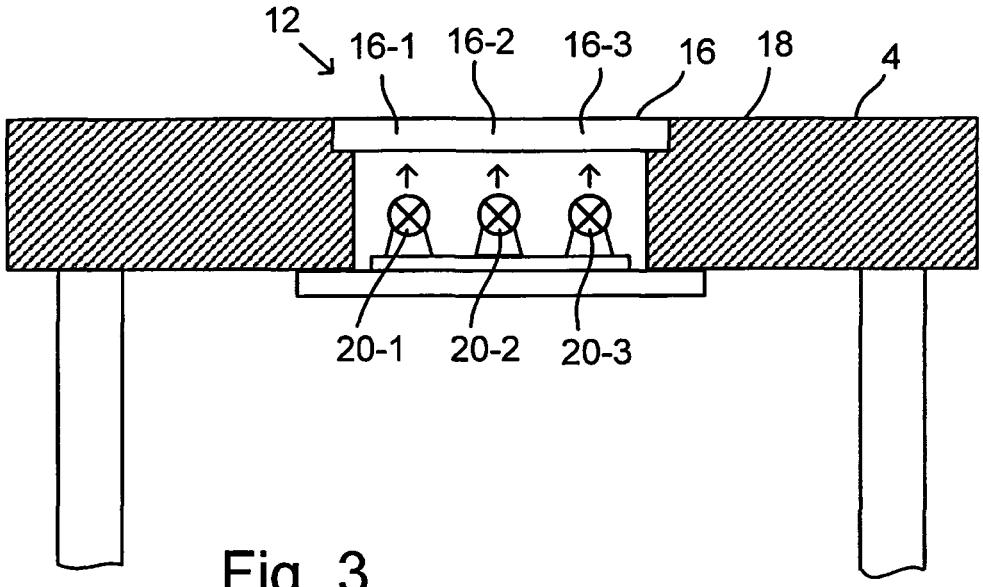
Figure 4:
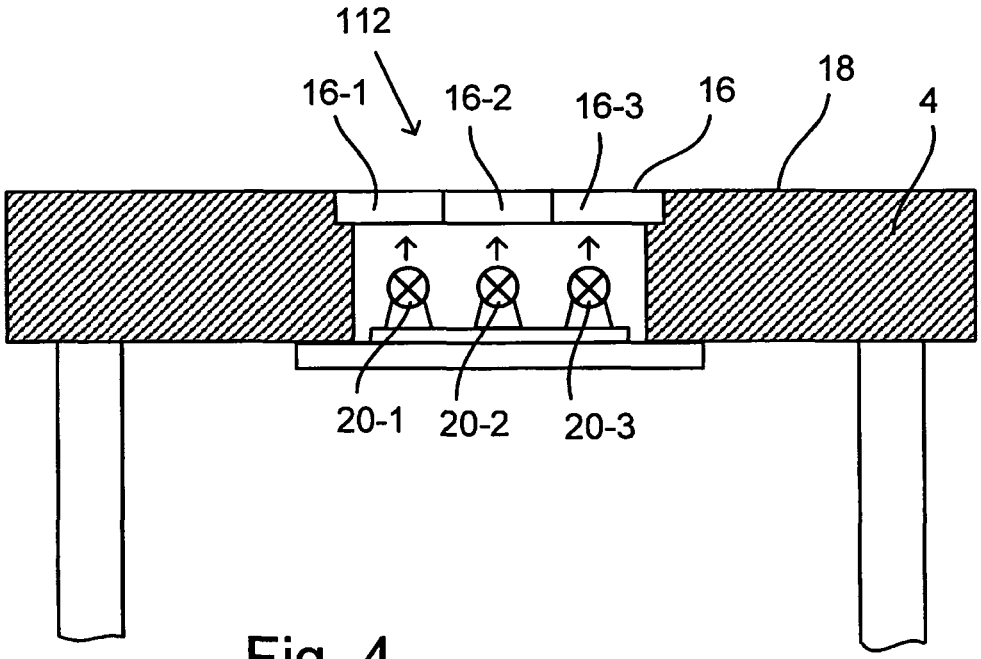
Figure 5:
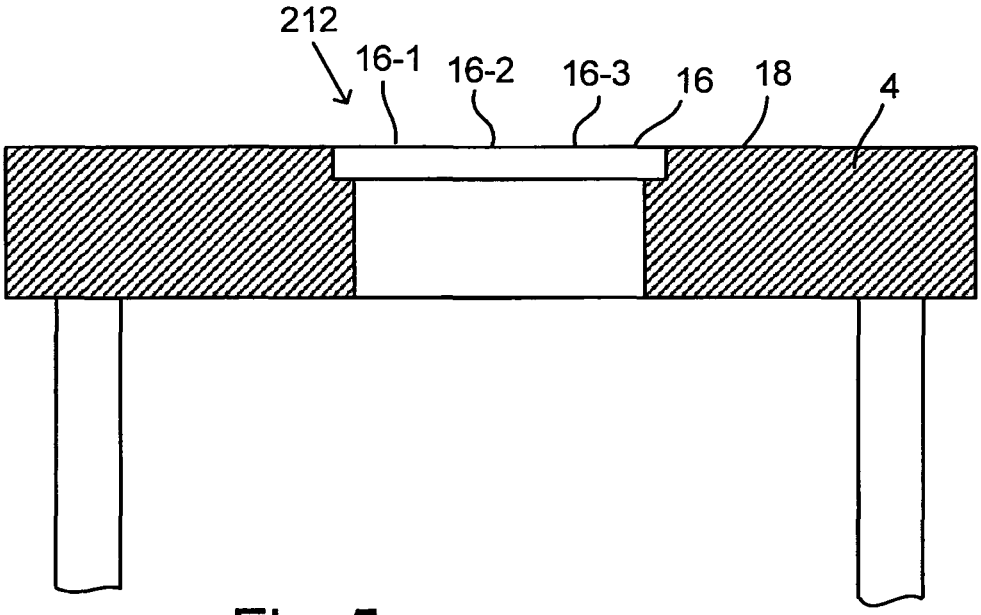

FIG. 1 is a schematic sideview of a pad printing machine fitted with a work board, FIG. 2 is a schematic topview of the pad printing machine and the work board of FIG. 1, FIG. 3 is a vertical section of the work board along the plane III-III of FIG. 2, FIG. 4 is a cross-section of a further embodiment mode of a pad printing machine's work board similar to FIG. 3 of the present invention, FIG. 5 is a cross-section similar to that of FIG. 3 of a further embodiment mode of the present invention.

Figure 6:
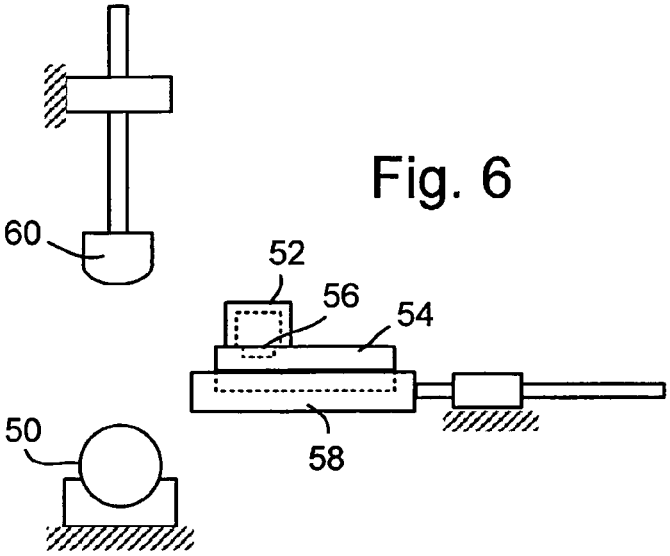
Figure 7:
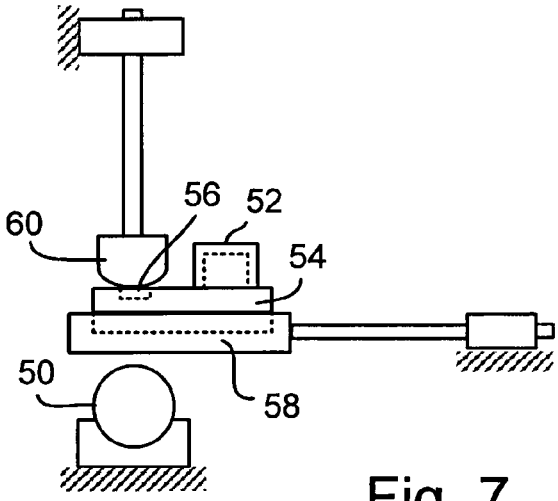
Figure 8:
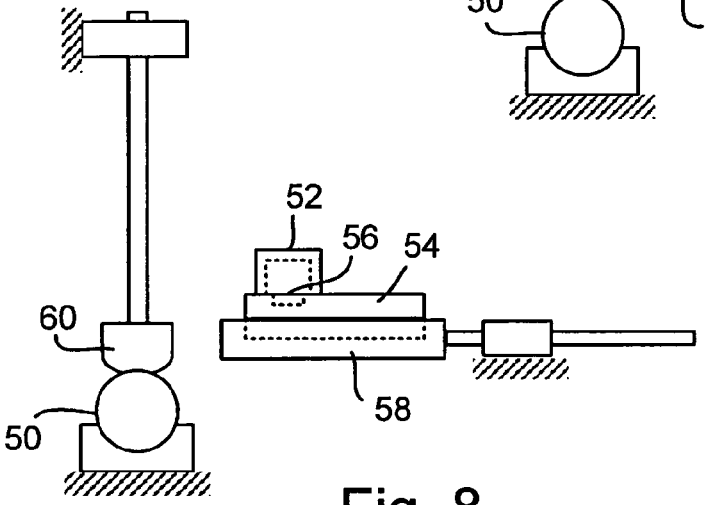

FIGS. 6, 7, 8 show the principle of the pad printing procedure, where FIG. 6 shows inking a print image on a printing block, FIG. 7 shows the ink transfer of the print image from the printing block to a pad and FIG. 8 the transfer of the print image from the pad to a workpiece to be printed.

The pad printing machine 2 shown in FIGS. 1 and 2 is fitted with a work board 4 configured in such manner in front of the printing machine that an operator 6 being in a work position before the work board 4 can reach across and over the work board 4 into a front insertion zone 8 of said printing machine to place workpieces from the work board 4 into the pad printing machine or remove them from it and put them on the work board. The insertion zone 8 in general may be an access zone in the pad printing machine also allowing checking or exchanging tools (for instance printing blocks, pads) and/or operational elements (for instance inks or ink cups).

FIG. 1 shows the pad printing machine 2 resting on a base 2-2 and the work board 4 resting on legs 4-2. In another embodiment mode of the invention, the pad printing machine 2 may rest on the work board 4 illustratively between the base 2-2 and the pad printing machine 2 and projecting forward.

Another embodiment also is practical, namely the work board 4 being leg-less but instead being supported by the pad printing machine 2.

A display 12 is operationally connected to a control unit 14 of the pad printing machine 2 either in hard-wired or wireless manner for the purpose of automatically displaying the particular printing machine status of at least two different machine states of the pad printing machine.

The optical display 12 comprises an optical display area 16 configured on the work board 4 between the pad printing machine 2 and the operational position of the operator 6 running the pad printing machine across the work board 4 and within the field of view of this operator. In the preferred embodiment mode, the optic display 12 is integrated into the work board 4.

The optical display area 16 preferably shall be flush with the surface 18 of the work board 4. The optical display area 16 per se may be part of the surface 18 of the work board 4.

The optical signals of the said display area may be a legible script and/or graphics and/or signal colors.

In the preferred embodiment of the present invention, the display 12 is designed to generate at least one optical signal for the machine state "machine intake zone 8 is accessible" and to one optical signal for the machine state "machine intake zone 8 is closed".

In a preferred embodiment mode of the present invention, the display 12 displays the signal color green denoting the machine state "machine intake zone 8 is accessible" in the optical display area 16 and the signal color red for the machine state "machine intake zone 8 is closed".

In a further preferred embodiment mode of the present invention, the optical display 12 is designed to display further machine information in the optical display area 16, illustratively when a workpiece to be printed is properly positioned, or positioned and affixed, in the pad printing machine 2 and therefore is ready for printing. Another signal color may be used for such a purpose, for instance blue, or a combination of two or more colors.

As shown by the topview of FIG. 2, the optical display 16 may comprise a display strip 16-1 for instance for a red signal color, a display strip 16-2 for instance for a blue signal color and a display strip 16-3 for instance for a green signal color. In another embodiment mode, all optical data, for instance signal colors, may be displayed consecutively alternatingly in the same or in a single display strip.

The signal colors may be generated in a number of ways, Illustratively the state of the art includes luminous sources of diverse colors such as incandescent bulbs or fluorescent lamps or halogen bulbs. Also light transparent glass or plastic elements of different colors are available.

FIG. 3 cross-sectionally shows an optical display area in the form of light transmitting, transparent or white glass or plastic plate. Below said plate's display strip 16-1 is situated an illustratively red bulb 20-1, below its display strip 16-2 a bulb 20-2 transmitting another signal color, for instance blue, and below the third display strip 16-3 a bulb 20-3 transmitting, another signal color, for instance green, all bulbs being part of the display 12.

In a further embodiment mode of the present invention shown in FIG. 4, the optical display area 16 consists of three optical display strips of different colors, for instance one red light transmitting display strip 16-1, one blue light transmitting display strip 16-2 and one green light transmitting display strip 16-3, each above a bulb respectively 20-1, 20-2 and 20-3 each generating the same color light, for instance white, while being luminous at the surfaces of the display area 16 in the color of the particular display strip 16-1, 16-2 or 16-3.

The pad printing machine of FIGS. 1 and 2 may be fitted with a light beam barrier 40 in all embodiment modes, said light beam barrier being configured in the intake zone 8 where the operator 6 my insert the workpieces 10 into the pad printing machine 2 respectively retrieve them from it. The light beam barrier closes the intake zone 8 and thereby implements the operational state "machine intake zone closed", stopping the pad printing machine when the light barrier's beam is interrupted, for instance by a hand of the operator 6 blocking it. On the other hand the light beam barrier 40 allows access to the intake zone 8 when the pad printing machine is not printing, that is in the operational state "machine intake zone is accessible".

FIG. 2 is a schematic topview of a light transmitter 42 and a light receiver 44 and the light barrier beam 46 of the light beam barrier 40. The light beam barrier 40 is operationally connected to the control unit 14 of the pad printing machine 2.

FIG. 5 shows another preferred embodiment mode of the present invention. In this embodiment mode, the optical display 212 consists of a display panel, for instance a flat monitor screen of which the light emitting elements may be driven by the control unit 14 of the pad printing machine to optically display the particular machine state in the optical display area 16 of the display panel. A number of applications are allowed by this design. One application consists in displaying various machine states in different display area strips 16-1, 16-2 and/or 16/3. Another consists in always displaying the particular machine state at the same site of the optical display area 16. The light generating elements may be LED's (Light Emitting Diodes), LCD's (Liquid Crystal Displays) or elements containing a gas or plasma. Preferably the optical display area 16 is mounted flush with the surface 18 of the work board 4.

FIGS. 6, 7 and 8 illustrate printing a workpiece 50 awaiting printing. In FIG. 6, ink from an ink cup 52 is deposited on the print image engraved or etched into the printing block 54 resting on a printing block support 58 in an ink receiving position retracted to the right as regards the drawings.

In FIG. 7 the printing block 54 is situated in an ink transfer position offset toward the left, wherein a pad 60 absorbs ink from the printing block print picture 56.

FIG. 8 shows the printing block once more in the position of FIG. 6 and the pad 60 in a position where the workpiece 50 is being printed.

The obliquely shaded portions shown in FIGS. 6, 7 and 8 denote those elements which are connected to each other by an omitted machine frame.

The invention claimed is:

1. A pad printing machine, comprising:

an intake zone defined in the pad printing machine, a work board that runs in front of the pad printing machine and dimensioned and configured such that an operator situated before the work board in a work position can reach beyond the work board into the pad printing machine for inserting workpieces from and above the work board into the pad printing machine through the intake zone or removing said workpieces from said pad printing machine and place said workpieces on the work board, a light beam barrier having a light transmitter disposed on an end of the intake zone and a light receiver disposed at an opposite end of the intake zone, a control unit, an optical display operationally connected to said control unit of the pad printing machine in order to optically display at least one machine state as a machine intake zone accessible, and another machine state as a machine intake zone is closed, the optical display comprising an optical display area positioned on the work board, wherein the work board is positioned between the pad printing machine and an operational position of the operator operating the pad printing machine across the work board within a field of view of this operator, wherein when the pad printing machine is printing, the control unit is configured to control the light beam barrier to emit a light beam from the light transmitter and received by the light receiver to close the intake zone and to control the optical display to optically display the machine intake zone closed state, and wherein when the pad printing machine is not printing, the control unit is configured to control the optical display to optically display the machine intake zone accessible state.

2. The pad printing machine of claim 1, wherein the optical display is integrated into the work board.

3. The pad printing machine of claim 2, wherein the optical display area is configured on a surface of the work board and flush with said surface.

4. The pad printing machine of claim 1, further comprising an optical signal generated by said optical display for indicating the machine state "machine intake zone is accessible" and another optical signal generated by said optical display for indicating the machine state "machine intake zone is closed".

5. The pad printing machine of claim 4, further comprising a further optical signal generated by said optical display for at least one further machine state.

6. The pad printing machine of claim 5, wherein the further optical signal relates to a machine state arising when a workpiece is in a position to be processed in the pad printing machine.

7. The pad printing machine of claim 1, wherein the optical display is configured to display different luminous signal colors, a different signal color or color combination being assigned to each machine state.

8. The pad printing machine of claim 7, wherein a color green is assigned to the machine state "machine intake zone is accessible" and a color red is assigned to the machine state "machine intake zone is closed".

9. The pad printing machine of claim 1, wherein when the light beam is interrupted in the machine intake zone closed state, the light beam barrier automatically stops the operation of the pad printing machine using the control unit, and the light beam barrier opens the machine intake zone when the pad printing machine is shut down, namely in the machine intake zone open state.

10. The pad printing machine of claim 1, wherein the optical display as well as the work board is movable with respect to the intake zone of the pad printing machine.

* * * * *